US005295462A

United States Patent [19]

Barnes et al.

[11] Patent Number: 5,295,462

[45] Date of Patent: Mar. 22, 1994

[54] COIN INSERT FOR THE FIRING DECK IN AN INTERNAL COMBUSTION ENGINE

[75] Inventors: Steve G. Barnes, Columbus, Ind.; Kurt W. Schoenegge, Sheboygan, Wis.

[73] Assignee: Cummins Engine Co., Inc., Columbus, Ind.

[21] Appl. No.: 962,258

[22] Filed: Oct. 16, 1992

[51] Int. Cl.[5] ..... F02F 1/18

[52] U.S. Cl. ..... 123/193.5; 123/41.82 A

[58] Field of Search ..... 123/41.82 A, 193.3, 123/193.5, 668, 669

[56] References Cited

U.S. PATENT DOCUMENTS

| | | | |
|---|---|---|---|
| 1,479,129 | 1/1924 | Feilner | 123/41.76 |
| 3,115,127 | 12/1963 | Spencer et al. | 123/41.82 R |
| 4,034,723 | 7/1977 | Hamparian | 123/41.76 |
| 4,112,906 | 9/1978 | Spencer | 123/41.76 |
| 4,328,772 | 5/1982 | Heydrich et al. | 123/669 |
| 4,344,390 | 8/1982 | Heydrich et al. | 123/41.82 A |
| 4,524,732 | 6/1985 | Dworak et al. | 123/193.5 |

*Primary Examiner*—Noah P. Kamen
*Attorney, Agent, or Firm*—Woodard, Emhardt, Naughton, Moriarty & McNett

[57] ABSTRACT

An internal combustion engine cylinder assembly includes a coin insert disposed at the top end of the cylinder acting as a firing deck. The coin insert is formed of a super alloy material and is situated within a recess defined in the cylinder head. A radial clearance is provided between the cylinder head and the coin insert to allow for thermal expansion during engine combustion. In one embodiment, the coin insert is welded to the cylinder head at a location immediately adjacent the fuel injector to directly transfer injector and combustion loads through the insert into the cylinder head. In a second embodiment, a coin insert is welded to an injector sleeve which is disposed within the injector bore of the cylinder head between the cylinder head and the fuel injector. The injector sleeve includes an upper ledge disposed from the injector opening through which loads are transmitted from the coin insert into the upper part of the cylinder head. In a third embodiment, a much thicker coin insert is mechanically constrained between the cylinder head and the cylinder liner. In a further aspect of each of the embodiments of the coin insert, notches are defined in the face of the coin insert disposed against the cylinder head for receiving a C-seal. The C-seal is a compliant gas seal which expands to tighten the seal between the cylinder head and the coin insert, as combustion gases enter the opening of the seal.

12 Claims, 3 Drawing Sheets

COIN INSERT FOR THE FIRING DECK IN AN INTERNAL COMBUSTION ENGINE

BACKGROUND OF THE INVENTION

The present invention concerns a coin insert for the firing deck of a combustion chamber in an internal combustion engine. More specifically, the invention concerns means for strengthening and supporting the insert and for supporting the insert to permit expansion due to thermal loads.

During normal operation of various types of internal combustion engines, the surfaces of certain of the components of the engine defining the combustion chamber, attain temperatures within the range of 1500–1800° F. Such temperatures prohibit the use of conventional sealing methods and can cause metals to become inherently weak. The heat of combustion within the combustion chamber can cause inordinate thermal loads to be imposed on the engine block or more specifically the firing deck at the cylinder head. The thermal stresses caused by the intense heat in the combustion chamber frequently cause distortion and/or cracking of the firing deck of the cylinder head so that a new head is required or so that the cracks must be sealed and machined for reuse. Moreover, heat loss through the walls of the cylinder or through the cylinder head can lead to waste of a substantial amount of the energy produced by combustion.

To preclude and/or minimize these problems, coin inserts have been used to protect the firing deck area of the engine body, and particularly the cylinder head. In this instance, the exposed face of the insert constitutes the firing deck which is subjected to the greatest heat generated during the operation of the engine. The coin or firing deck insert then absorbs the lion's share of the thermal stresses associated with the heat of combustion, thereby insulating the cylinder head from the high thermal loads.

The patents to Heydrich et al., U.S. Pat. Nos. 4,328,772 and 4,344,390, owned by the assignee of the present invention, disclose one type of coin insert or end piece. The end piece disclosed in these patents is mechanically restrained between the cylinder head and the cylinder liner of the engine block. Radial clearance is provided around the periphery of the end piece to permit radial expansion during high-temperature conditions. One problem associated with end pieces according to either of these references is that the end piece can endure excessive deflection and cyclic loading due to injector forces, and the forces of combustion and thermal expansion. This excessive deflection or cyclic loading can lead to fatigue failure of the end piece.

The patent to Spencer, U.S. Pat. No. 4,112,906, shows a firing deck insert for an internal combustion engine which includes a boss that is threaded into the cylinder head to support the insert. The configuration of the firing deck insert in Spencer requires a certain amount of precision machining for the firing deck insert. Moreover, there is no provision in this reference of some means for sealing around the valve openings in the insert.

There is a need for a coin or firing deck insert which is capable of absorbing the thermal heat and thermal loads associated with combustion in the engine cylinder. The need extends to a coin insert that is configured to handle the high cyclic loads imposed on the firing deck and at the fuel injector. The insert should be relatively simple to machine and install, while still providing the benefits of prior coin inserts.

SUMMARY OF THE INVENTION

In one aspect of the invention, a cylinder assembly for an internal combustion engine is provided which comprises an engine block defining a cylindrical bore with a cylinder liner disposed therein. A piston can be disposed within said liner for reciprocation therein. A cylinder head is mounted at one end of the engine block covering the cylindrical bore. The cylinder head has a firing deck surface which defines a cylindrical recess concentric with the cylindrical bore. The cylinder head further has a number of valve bores and an injector bore defined therethrough. A fuel injector can be situated within the injector bore.

A disc-shaped coin insert is disposed within the cylindrical recess which is formed of a thermal insulative material. The coin insert and the cylinder liner define a combustion chamber within the engine, with the coin insert acting as a firing deck. The coin insert has a number of valve openings and an injector opening defined therethrough which are disposed in corresponding alignment with the number of valve bores and the injector bore in the cylinder head.

In one embodiment of the invention, the coin insert includes a boss formed around the injector opening which is sized to fit within the injector bore of the cylinder head. The boss of the coin insert is welded to the cylinder head at the cylinder bore to provide a path to react transverse loads applied to the coin insert, such as injector loads and combustion forces.

In another feature, the coin insert has an upper surface disposed against the cylinder head which defines a number of seal notches concentric with and opening to a corresponding one of the number of valve openings. In each of the seal notches is disposed a compliant gas seal which has a portion exposed to the combustion chamber. The gas seal is preferably a C-shaped seal with the opening of the seal exposed to the combustion chamber so that the combustion gas causes the compliant seal to exert a greater sealing force between the cylinder head and the coin insert around the valve bore.

In a further feature of the invention, the cylindrical recess at the firing deck surface of the cylinder head has a diameter greater than the outer diameter of the disc-shaped coin insert. Thus, the coin insert is radially unconstrained at its outer diameter to permit radial thermal expansion of the insert when it is exposed to the high combustion temperatures. Outer diameter of the coin insert is also larger than the inner diameter of the cylinder liner so that the cylinder liner constrains the coin insert against transverse deflection at its outer diameter.

In a further embodiment of the invention, a cylindrical injector sleeve is provided which is concentrically disposed within the injector bore. The injector sleeve has an upper portion at one end of the sleeve which is engaged to the cylinder head distal the firing deck surface, and a lower portion at its opposite end which is adjacent the firing deck surface. The coin insert is modified to include a recess formed around its injector opening. The recess is sized to receive the lower portion of the injector sleeve therein. The coin insert is welded at the recess to the lower portion of the injector sleeve so that transverse loads exerted on the coin insert are reacted through the injector sleeve into the cylinder head at the upper portion of the injector sleeve remote from the firing deck. In this manner, injector loads and combustion forces which tend to cause the coin insert to deflect are reacted through the insert and through the injector sleeve into the cylinder head at a portion of the head having greater material mass and thickness.

In yet another embodiment of the invention, a thick disc-shaped coin insert is disposed within the recess in the cylinder head. This thick coin insert is essentially unconstrained against transverse deflection at its central portion adjacent the injector opening. The greater material thickness allows the insert to withstand the injector loads and combustion forces at its center without requiring load transmission into the cylinder head. The coin insert has an outer diameter greater than the inner diameter of the cylinder liner so that only the outer diameter or perimeter of the insert is constrained against transverse deflection.

In a further aspect of the thick coin insert, a seal groove is provided concentric with each of the valve openings of the insert. A compliant gas seal is disposed within each seal groove with the C-shaped seal opening toward the cylinder head.

It is one object of the present invention to provide a coin or firing deck insert which can provide thermal protection to the cylinder head. A desired object is to provide such an insert which is capable of withstanding the high transverse loads or forces exerted on the coin insert, such as injector loads and combustion forces.

A further object is to provide a coin insert which provides improved sealing about the valve openings. Another object is to provide each of these features in a coin insert that is relatively easily and cheaply produced.

Additional objects and certain benefits of the present invention will become apparent from the following written description and accompanying figures.

DESCRIPTION OF THE PREFERRED EMBODIMENTS

Figure 1:
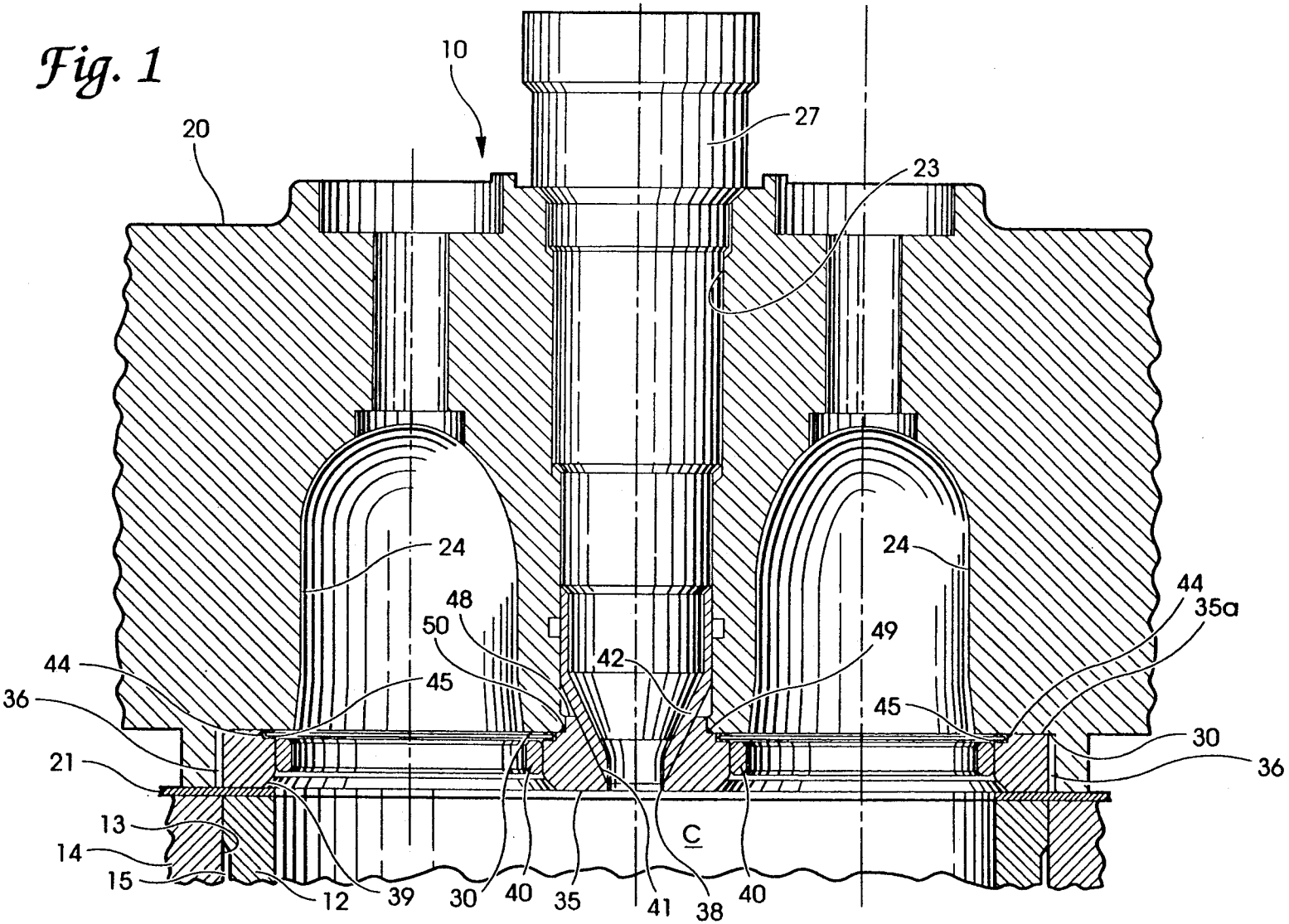
FIG. 1 is a fragmentary sectional view of the firing deck of an internal combustion engine of the fuel injector or diesel type specifically showing one embodiment of the coin insert of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A cylinder assembly 10 of an combustion engine is depicted in FIG. 1. The assembly includes a cylinder liner 12 situated within a cylinder bore 13 in the engine block 14. A circumferential recess in the cylinder liner 12 provides a cooling gap 15 for cooling of the cylinder liner during combustion. A cylinder head 20 is mounted at the head end of the engine block 14. A head gasket 21 is provided between the head 20 and block 14 for providing sealing between cylinders. In a conventional engine, the cylinder head 20 typically constitutes the firing deck.

The cylinder head 20 includes an injector bore 23 and a number of valve bores 24. A fuel injector 27 can be mounted within the injector bore 23 for providing fuel to the cylinder combustion chamber C. Intake and exhaust valves (not shown) can be mounted to reciprocate within the valve bores 24 in a conventional fashion.

The cylinder head 20 includes a cylindrical shaped coin recess 30 defined in the firing deck above cylinder C. A coin insert 35 is slidably disposed within the recess 30. (The coin insert is also often referred to as an end piece, firing deck insert, or hot plate). The coin recess 30 has a diameter that is larger than the coin insert 35, thereby providing a radial gap 36 between the insert and the cylinder head 20. This gap allows for radial thermal expansion of the coin insert 35. In many prior coin insert configurations, no radial gap is provided so that as the insert thermally expands stresses are built up because the perimeter of the insert is radially restrained. Provision of the gap 36 allows the insert to expand a significant amount as it is heated by the combustion gas, without being restrained by contact with the cylinder head. The perimeter of the coin insert 35 is situated between the head 20 and cylinder liner 12 and is constrained against deflection perpendicular to the coin insert at this location.

The coin insert 35 in this embodiment is generally disc-shaped, with a number of openings provided therethrough. In particular, an injector opening 38 and a number of valve openings 39 are defined in the coin insert which are arranged to align with the ejector bore 23 and valve bores. A valve seal 40 can be pressed into the coin insert 35 to provide a sealing surface for valves (not shown) reciprocating within the valve bores 24 and valve openings 39. Injector opening 38 includes a conical surface 41 disposed toward the fuel injector 27. A conical injector seal 42 is fitted between the conical surface 41 of the injector opening 38 and the fuel injector.

In one feature of the coin insert 35 of the present invention, a seal notch 44 is defined in one face of the insert at the valve opening 39. The seal notch 44 is preferably in the form of a right angle indentation at the valve opening 39 in the face 35*a* of the insert adjacent the cylinder head. A gas seal 45 is disposed within the notch 44 between the cylinder head 20 and the coin insert 35. In one specific embodiment, the seal 45 is a C-seal, which can be configured in the manner shown in U.S. Pat. No. 4,328,772 (20 shown in FIGS. 1 and 3) or U.S. Pat. No. 4,344,390 (item 21 in FIG. 2). The C-seal 45 acts as a compliant gas seal so that the introduction of combustion gases into the interior of the seal through its open side exert an outward pressure on the seal causing it, in turn, to exerts greater positive sealing force between the seal notch 44 and the cylinder head 20. The details of the construction of a C-seal acceptable for the present invention is in U.S. Pat. No. 4,328,772 at columns 2–3, which description is incorporated herein by reference.

In a further feature of the coin insert 35 of the present embodiment, the insert 35 includes a rim or boss 48 which is formed on face 35*a* of the insert around the injector opening 38. The boss 48 is cut back slightly toward the injector opening 38 to accommodate a ledge 49 formed in the cylinder head 20 to project into the injector bore 23. The ledge 49 provides means for positively positioning the coin insert 35 as the boss 48 seats within the ledge 49 in the injector bore 23. The coin insert endures large cyclic loads around the injector 27 and injector opening 38. Injector loads and combustion forces, coupled with thermal loads, can cause the coin insert to deflect in a "drum mode" due to the constraint at the perimeter of the insert. The present invention contemplates means for reacting these harsh cyclic loads through the coin insert 35 to the cylinder head 20 which has greater mass and stiffness to withstand the loads. Consequently, in one feature of the present invention coin insert boss 48 is used or brazed to the cylinder ledge 49 at a weldment 50. Thus, load applied to the coin insert is transmitted through the weldment 50 directing it to the bulkier cylinder head 20 so that the insert itself does not absorb the entire brunt of the combustion forces. Moreover, this fixation at the center of the insert still permits radial thermal expansion.

The weldment 50 for engaging the coin insert 35 to the cylinder head 20 can be readily accomplished through the injector bore 23 of the head, prior to insertion of the injector seal 42 and fuel injector 27.

Figure 2:
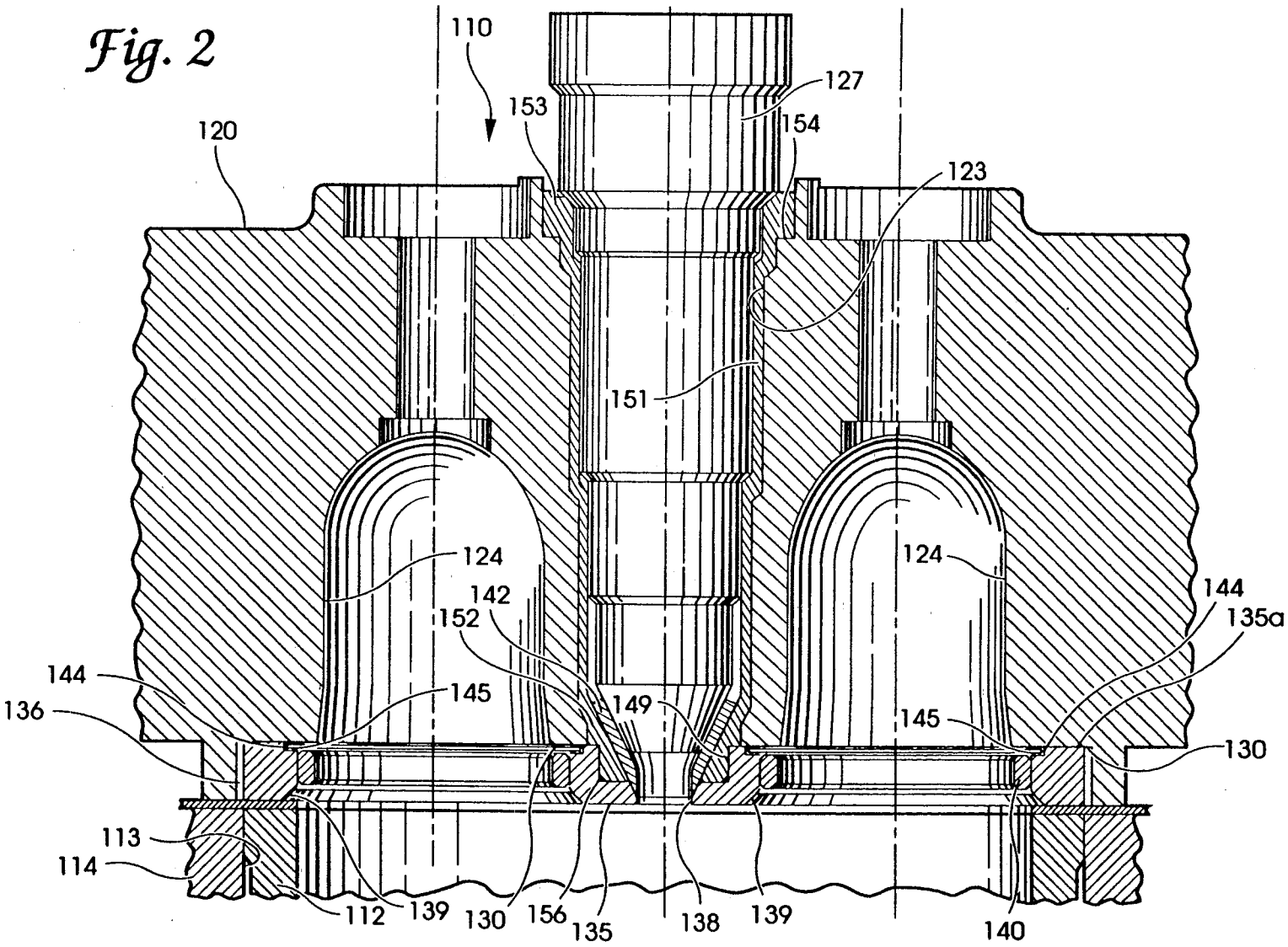
FIG. 2 is a fragmentary sectional view of a firing deck similar to FIG. 1 illustrating a second embodiment of the coin insert of the present invention.

Referring now to FIG. 2, in another embodiment of the present invention, a cylinder assembly 110 includes a cylinder liner 112 and a cylinder head 120. The cylinder head 120 and other components of the cylinder are configured substantially the same as the like components from the previous embodiment. A fuel injector 127 is disposed within an injector bore 123 in the cylinder head 120.

Likewise the cylinder assembly 110 of this embodiment includes a coin recess 130 defined in the cylinder head to receive a coin insert 135. The coin insert 135 is configured substantially the same as coin insert 35, such as by the inclusion of an injector opening 138 and a number of valve openings 139 therethrough. However, in a modification from the coin insert 35 of the prior embodiment, coin insert 135 shown in FIG. 2 includes a sleeve recess 149 defined in the face **135*a* around the injector opening 138 in the coin insert 135. An injector sleeve 151 is provided which surrounds the fuel injector 127 and which is situated within the injector bore 123. The injector sleeve 151 includes a lower ledge 152 which extends into the sleeve recess 149 of the coin insert 135. An upper ledge 153 is provided which is situated within a recess 154 at the top of the cylinder head 120**.

In one specific embodiment, the coin insert 135 is welded or brazed to the injector sleeve 151 at weldment 156 between the sleeve recess 149 and the sleeve lower ledge 152. The weldment 156 can be replaced by a threaded engagement between sleeve recess 149 and injector sleeve 151. The sleeve itself is generally loosely situated within the injector bore 123, being unconstrained between the lower ledge 152 and the upper ledge 153. The upper ledge 153 of the injector sleeve 151 is preferably fixed to the recess 154 of the cylinder head 120 so that cyclic loads can be transmitted from the coin insert 135 through the injector sleeve 151 to the upper portion of the cylinder head 120. Thus, the injector loads are transferred to an area of the cylinder head that is farther removed from the combustion chamber C and that is inherently stronger than the coin insert 135 due to the greater amount of material at that location.

Figure 3:
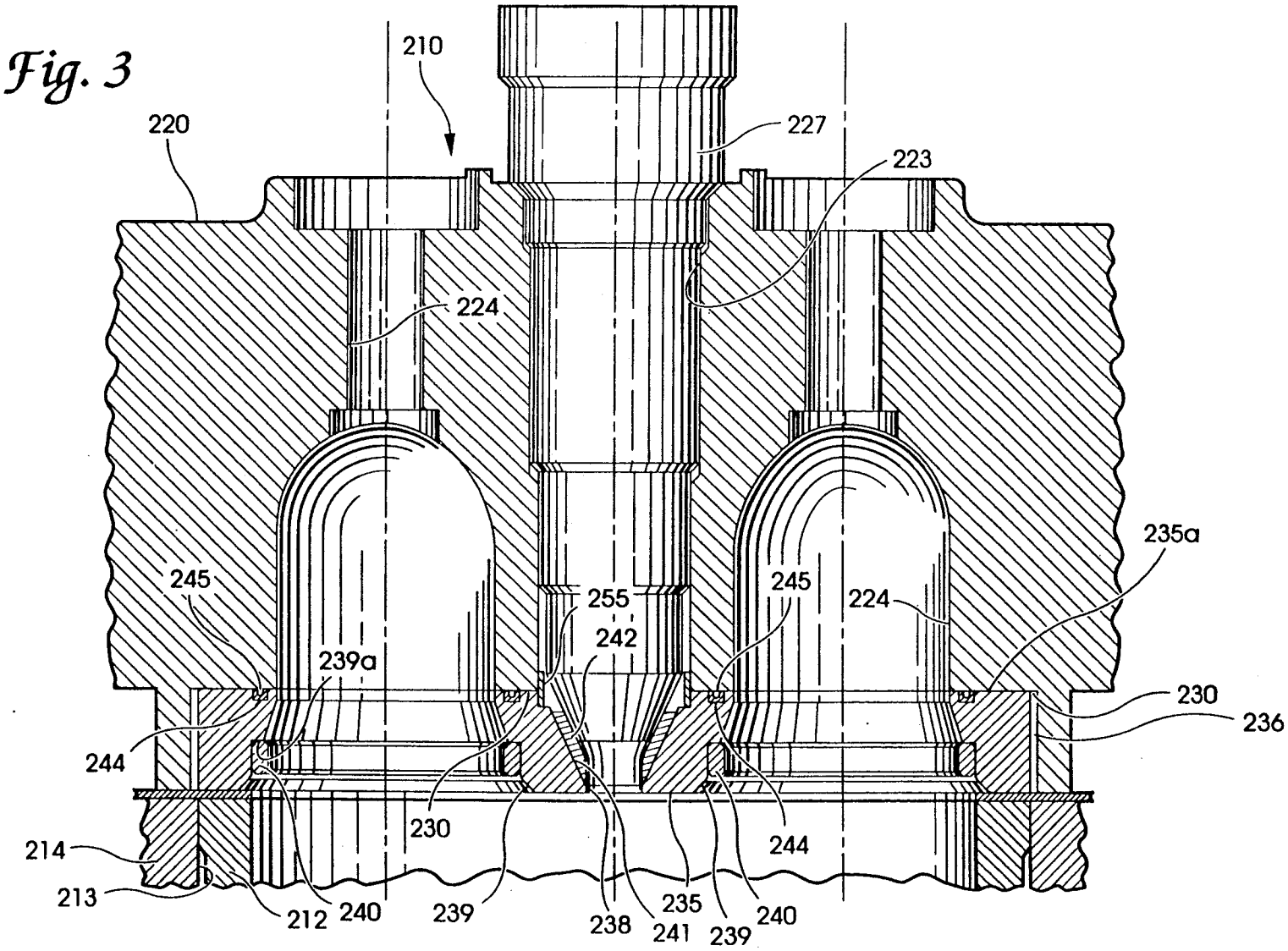
FIG. 3 is a fragmentary sectional view of a firing deck similar to FIG. 1 illustrating a third embodiment of the coin insert of the present invention.

In a further embodiment of the present invention, a cylinder assembly 210 is shown in FIG. 3. The cylinder assembly 210 includes a cylinder liner 212 and cylinder head 220 similar to the like components from previous embodiments. In this embodiment, the cylinder head includes a coin recess 230 which is cut more deeply into the head than the recesses from the previous embodiments. Similarly, a thicker coin insert 235 is provided which is seated within the recess, although the same radial gap is provided between the cylinder head 220 and the coin insert 235 as is shown in the prior embodiments.

The coin insert 235 of the embodiment shown in FIG. 3 includes an injector opening 238 and a number of valve openings 239 defined therethrough. A conical surface 241 is defined in the injector opening 238 to receive an injector seal 242 between the coin insert 235 and the fuel injector 227. In a modification front the prior embodiments, each of the valve openings 239 defines a seal notch **239*a* within which is received a valve seal 240. The valve seals 240 are similar to the valve seals 40 of the first embodiment (FIG. 1) which provide a sealing surface for the valve elements (not shown) reciprocating within the valve bores 224 of the cylinder head 220**.

In a further modification, the face **235*a* adjacent the cylinder head includes a seal groove 244 defined around each valve opening 239. The seal groove 244 is generally concentrically disposed around and radially displaced from the valve opening 235 and is adapted to receive a gas seal 245 therethrough. Preferably, the valve seal 245** comprises the C-seal referred to above.

The coin insert 235 of the embodiment of FIG. 3 has a thickness approximately twice as great as the thickness of either of the previous coin inserts 35 and 135. Thus, the coin insert 235 need only be mechanically constrained at its perimeter between the cylinder liner 212 and the cylinder head 220. The thicker material of the coin insert 235 allows it to withstand injector and combustion loads without requiring welding or brazing as with the coin inserts of the prior embodiments shown in FIGS. 1 and 2. The thicker material of coin insert 235 means less deflection under the same loads than would be experienced by the thinner inserts 35 and 135.

A locator ring 255 is provided to generally align the coin insert 235 and its openings 238 and 239 with the corresponding bores 223 and 224 in the cylinder head 220. The locator ring 255 can be loosely fit within injector bore 223 to permit transverse deflection of the coin insert 235.

Each of the coin inserts 35, 135 and 235 of the embodiments of the present invention are preferably formed of a superalloy capable of withstanding the extremely high temperatures in the combustion chamber C of known internal combustion engines. One such material can be a nickel-base alloy. The coin inserts of the present invention are adapted to accommodate radial expansion due to the high temperatures, as well as loads caused by the injector and combustion forces. Some deflection of the inserts can also be caused by pre-loading forces of the injector.

Each of the embodiments of the present invention solve the problem of high cyclic loads at the fuel injector. In the first embodiment, the coin insert 35 is welded or brazed to the cylinder head 20 itself around the injector area. Thus, the injector loads are transferred directly into the cylinder head at the firing deck. In the second embodiment, the injector sleeve can be formed of the same superalloy material as the coin insert 135. The coin insert 135 is welded to the injector sleeve 151, which is itself engaged to the upper portion of the cylinder head. Thus, the injector loads are transferred through the coin insert 135 and injector sleeve 151 to the cylinder head at a location remote from the injector opening.

Finally, in the third embodiment, the coin insert 235 has a much greater thickness than prior coin inserts. Thus, the coin insert 235 is capable of withstanding the high injector and combustion loads exerted at the center of the coin insert, while being mechanically supported only at its perimeter between the cylinder head and the cylinder liner. While the coin insert 235 of the third embodiment utilizes a greater amount of expensive superalloy material, it can be readily removed and serviced. Each of the coin inserts 35, 135 and 235 are unconstrained in the radially outward direction to account for thermal expansion.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cylinder assembly for an internal combustion engine comprising:

an engine block defining a cylindrical bore;

a cylinder liner disposed within said cylindrical bore for receiving a reciprocating piston therein;

a cylinder head mounted at one end of said engine block covering said cylindrical bore, said cylinder head having a firing deck surface, said surface defining a cylindrical recess concentric with said cylindrical bore, said cylinder head further having a number of valve bores and an injector bore defined therethrough; and a disc-shaped coin insert disposed within said cylindrical recess, said coin insert being formed of a thermal insulative material and together with said cylinder line defining a combustion chamber, said coin insert having a number of valve openings and an injector opening defined therethrough disposed in corresponding alignment with said number of valve bores and said injector bore, said coin insert further having a boss formed around said injector opening and sized to fit within said injector bore of said cylinder head;

wherein said boss of said coin insert is welded to said cylinder head at said injector bore.

2. The cylinder assembly of claim 1, wherein:

said coin insert has an upper surface disposed against said cylinder head, said upper surface defining a number of seal notches concentric with an opening to a corresponding one of said number of valve openings; and a number of compliant gas seals disposed within a corresponding one of said number of seal notches, each of said gas seals having a portion exposed to said combustion chamber.

3. The cylinder assembly of claim 1, wherein:

said injector opening defines a conical surface toward said injector bore; and said assembly further includes a conical injector seal disposed within said injector opening against said conical surface.

4. The cylinder assembly of claim 1, wherein:

said cylindrical recess has a diameter greater than the outer diameter of said disc-shaped coin insert; and said coin insert is radially unconstrained at its outer diameter to permit radial thermal expansion of said insert.

5. The cylinder assembly of claim 4, wherein said cylinder liner has an inner diameter smaller than said outer diameter of said coin insert, whereby said cylinder liner constrains said coin insert against transverse deflection at said outer diameter.

6. A cylinder assembly for an internal combustion engine comprising:

an engine block defining a cylindrical bore;

a cylinder liner disposed within said cylindrical bore for receiving a reciprocating piston therein;

a cylinder head mounted at one end of said engine block covering said cylindrical bore, said cylinder head having a firing deck surface, said surface defining a cylindrical recess concentric with said cylindrical bore, said cylinder head further having a number of valve bores and an injector bore defined therethrough;

a cylindrical injector sleeve concentrically disposed within said injector bore, said injector sleeve having an upper portion at one end of said sleeve engaged to said cylinder head distal said firing deck surface and a lower portion at the opposite end of said sleeve adjacent said firing deck surface; and a disc-shaped coin insert disposed within said cylindrical recess, said coin insert being formed of a thermal insulative material and together with said cylinder liner defining a combustion chamber, said coin insert having a number of valve openings and an injector opening defined therethrough disposed in corresponding alignment with said number of valve bores and said injector bore, said coin insert further having a recess formed around said injector opening and sized to receive said lower portion of said injector sleeve therein;

wherein said coin insert is welded at said recess to said lower portion of said injector sleeve, whereby transverse loads exerted on said coin insert are reacted through said injector sleeve into said cylinder head at said upper portion of said injector sleeve.

7. The cylinder assembly of claim 6, wherein:

said coin insert has an upper surface disposed against said cylinder head, said upper surface defining a number of seal notches concentric with and opening to a corresponding one of said number of valve openings; and a number of compliant gas seals disposed within a corresponding one of said number of seal notches, each of said gas seals having a portion exposed to said combustion chamber.

8. The cylinder assembly of claim 6, wherein:

said injector opening defines a conical surface toward said injector bore; and said assembly further includes a conical injector seal disposed within said injector opening against said conical surface.

9. The cylinder assembly of claim 6, wherein:

said cylindrical recess has a diameter greater than the outer diameter of said disc-shaped coin insert; and said coin insert is radially unconstrained at its outer diameter to permit radial thermal expansion of said insert.

10. The cylinder assembly of claim 9, wherein said cylinder liner has an inner diameter smaller than said outer diameter of said coin insert, whereby said cylinder liner constrains said coin insert against transverse deflection at said outer diameter.

11. A cylinder assembly for an internal combustion engine comprising:

an engine block defining a cylindrical bore;

a cylinder liner disposed within said cylindrical bore for receiving a reciprocating piston therein, said cylinder liner having an inner diameter;

a cylinder head mounted at one end of said engine block covering said cylindrical bore, said cylinder head having a firing deck surface, said surface defining a cylindrical recess concentric with said cylindrical bore, said cylinder head further having a number of valve bores and an injector bore defined therethrough;

a disc-shaped coin insert disposed within said cylindrical recess, said coin insert being formed of a thermal insulative material and together with said cylinder liner defining a combustion chamber, said coin insert having a number of valve openings and an injector opening defined therethrough disposed in corresponding alignment with said number of valve bores and said injector bore, said coin insert further having an outer diameter greater than the inner diameter of said cylinder line, whereby said cylinder liner constrains said coin insert against transverse deflection at said outer diameter; and a locator ring concentrically disposed between said injector bore and said injector opening to position said coin insert with respect to said cylinder head, wherein said coin insert is unconstrained at said injector opening against transverse deflection away from said cylinder head.

12. A cylinder assembly for an internal combustion engine comprising:

an engine block defining a cylindrical bore;

a cylinder liner disposed within said cylindrical bore for receiving a reciprocating piston therein, said cylinder liner having an inner diameter;

a cylinder head mounted at one end of said engine block covering said cylindrical bore, said cylinder head having a firing deck surface, said surface defining a cylindrical recess concentric with said cylindrical bore, said cylinder head further having a number of valve bores and an injector bore defined therethrough;

a disc-shaped coin insert disposed within said cylindrical recess, said coin insert being formed of a thermal insulative material and together with said cylinder liner defining a combustion chamber, said coin insert having a number of valve openings and an injector opening defined therethrough disposed in corresponding alignment with said number of valve bores and said injector bore, said coin insert further having an outer diameter greater than the inner diameter of said cylinder line, whereby said cylinder liner constrains said coin insert against transverse deflection at said outer diameter, wherein said coin insert is unconstrained at said injector opening against transverse deflection away from said cylinder head, and further wherein said coin insert has an upper surface disposed against said cylinder head, said upper surface defining a number of seal grooves concentrically disposed around a corresponding one of said number of valve openings; and said assembly further includes a number of complaint gas seals disposed within a corresponding one of said number of seal grooves, each of said gas seals having a portion exposed to said cylinder head.

* * * * *